US006428333B1

(12) United States Patent
Rust

(10) Patent No.: US 6,428,333 B1
(45) Date of Patent: Aug. 6, 2002

(54) LOCKING DEVICE FOR ELECTRICAL RECEPTACLES

(76) Inventor: Randall D. Rust, 9013 Glen Eagle Way, Tallahassee, FL (US) 32312

( * ) Notice: Subject to any disclaimer, the term of this patent is extended or adjusted under 35 U.S.C. 154(b) by 0 days.

(21) Appl. No.: 09/966,525

(22) Filed: Sep. 28, 2001

(51) Int. Cl.[7] ..... H01R 13/44
(52) U.S. Cl. ..... 439/140; 439/304
(58) Field of Search ..... 439/140, 133, 439/134, 340, 304, 139, 296, 535, 536, 544, 545, 549

(56) References Cited

U.S. PATENT DOCUMENTS

| | | | | |
|---|---|---|---|---|
| 2,654,073 A | | 9/1953 | Kutz | 439/134 |
| 2,664,734 A | | 1/1954 | McEneussy | 70/57 |
| 2,732,531 A | | 1/1956 | Junowie | 439/346 |
| 3,489,989 A | | 1/1970 | Robuzewski | 439/346 |
| 3,543,544 A | | 12/1970 | Fiston | 70/57 |
| 3,891,289 A | | 6/1975 | Hunlie | 439/106 |
| 4,136,919 A | | 1/1979 | Howard et al. | 439/346 |
| 4,530,556 A | | 7/1985 | Bonus | 439/296 |
| 4,566,297 A | | 1/1986 | Hawley | 70/57 |
| 4,700,997 A | | 10/1987 | Strand | 439/372 |
| 4,784,611 A | | 11/1988 | Povlin et al. | 439/346 |
| 4,909,749 A | | 3/1990 | Long | 439/263 |
| 4,990,094 A | * | 2/1991 | Chandler et al. | 439/108 |
| 5,286,213 A | | 2/1994 | Altergott et al. | 439/139 |
| 5,330,361 A | | 7/1994 | Brend | 439/134 |
| 5,409,393 A | | 4/1995 | Perkins et al. | 439/347 |
| 5,551,884 A | | 9/1996 | Burkhart, Sr. | 439/140 |
| 5,588,862 A | | 12/1996 | Perkins et al. | 439/347 |
| 5,641,298 A | | 6/1997 | Holloway | 439/346 |
| 5,791,931 A | | 8/1998 | Burkhart, Sr. | 439/346 |
| 5,921,799 A | | 7/1999 | Forrester | 439/346 |
| 5,941,724 A | | 8/1999 | Reed | 439/346 |
| 6,193,539 B1 | | 2/2001 | Chang | 439/346 |

* cited by examiner

*Primary Examiner*—Tulsidas Patel
(74) *Attorney, Agent, or Firm*—Peter Lofflen

(57) ABSTRACT

A plug lock locks the plug of an electrical appliance with a receptacle connected to a source of electrical power. The plug lock has wall plate having a pair of openings. A sheath has a pair of ends with a first passage extending between the two ends. An extension extends from the first end of the sheath, the extension being removably receivable within the second opening of the wall plate. A protrusion is disposed within the first passage of the sheath. A plug has a pair of ends and has a second extension extending from a third and a second passage extending between the two ends, the third end of the plug insertable into first passage at the sheath's second end and passable therethrough such that the second tab of the plug passes over the protrusion such that the protrusions prevent reverse passage of the plug through the first passage.

35 Claims, 4 Drawing Sheets

LOCKING DEVICE FOR ELECTRICAL RECEPTACLES

BACKGROUND OF THE INVENTION

1. Field of the Invention

The present invention relates to a device that locks an electrical plug within the electrical receptacle within which the plug is received.

2. Background of the Prior Art

A standard electrical connection involves a male plug, either two-pronged or three pronged, being received within a female receptacle of similar configuration, thereby completing an electrical connection between the source of electricity and an appliance that is desirous of being attached to the source of electricity via the male plug. This very common electrical configuration can be found in almost every location, both commercial and residential.

A problem encountered by this standard electrical connection arrangement is experienced by the undesired uncoupling of the male plug from the female receptacle thereby interrupting electrical communication between the plug and the electrical receptacle. In many instances, such uncoupling is of little moment, simply requiring the male plug to be plugged back into the female receptacle. Although such uncoupling is a minor nuisance, it carries little further consequence.

However, in many instances, the electrical uncoupling of an appliance from its source of electricity is more than a minor inconvenience. For instance, at a stage performance, if an actor inadvertently unplugs a sound board, the entire show may have an undesired repair break. Similarly, if an attendant unplugs a computer, not only may critical data be lost, but customers can be inconvenienced as the computer system is boot strapped, which process may take a relatively long time to complete.

In other instances, the unplugging of an electrical plug may prove to be dangerous. A guitarist who partially decouples a plug from its receptacle during an outdoor show at the onset of rain, may be inadvertently creating a very hazardous situation. Similarly, a small child, left unsupervised for even a small length of time, can be expected to play with a live electrical plug with potentially tragic results.

In order to prevent the inadvertent uncoupling of a plug from an electrical receptacle, many devices have been proposed, which devices temporarily lock the plug to its receptacle and prevent the uncoupling of the two items. While such devices work with varying degrees of efficiency, such prior art devices tend to suffer from of one two main drawbacks. Many such devices tend to have limited functionally in that they will only prevent some forms of uncoupling such as a person accidentally stepping on the wire connected to the plug, but offer little protection for a child playing with a plug plugged into an electrical socket.

Other devices, while keeping the plug securely held within its receptacle, are unduly complex in design and construction. Such devices either require elaborate measures in order to make the device functional, typically requiring the desired receptacle to be rewired. Otherwise, such devices are unduly complex in operation, making the use of the devices complex, thereby deterring frequent use of the devices by the average user.

Therefore, the exists a need in the art for a plug lock that couples a male electrical plug found on a typical electrical appliance with a female electrical receptacle and that secures the plug within the receptacle. Such a plug lock must be of relatively simple design and construction such that the device is relatively easy to install without the need to electrically rework the receptacle and must be relatively easy to use so that users are not dissuaded from using the device. The plug lock must prevent plug uncoupling in most instances.

SUMMARY OF THE INVENTION

The plug lock of the present invention addresses the aforementioned needs in the art. The plug lock couples a male electrical plug found on an electrical appliance with a female electrical receptacle and secures the plug within the receptacle. The plug lock is of relatively simple design and construction such that the device is relatively easy to install without the need to electrically rework the receptacle and is relatively easy to use so that users are not dissuaded from using the device. The plug lock prevents uncoupling of the plug from its receptacle in most instances.

The plug lock of the present invention is comprised of a wall plate having a first opening and a second opening located about the first opening, the wall plate being secured about a standard electrical receptacle such that the receptacle passes through the first opening. A sheath is provided, the sheath having a first end and a second end and having a first passage extending between the first end and the second end. A first extension with a first tab extends from the first end of the sheath, the first extension removably receivable within the second opening. At least one protrusion is disposed within the first passage the protrusion being located along a channel. A plug is provided, the plug having a third end and a fourth end and having a second extension with a second tab extending from the third end, and having a second passage extending between the third end and the fourth end, the third end of the plug insertable into the first passage at the second end of the first sheath and passable therethrough such that the second tab passes over each of the at least one protrusion such that each protrusion prevents reverse passage of the plug through the first passage. The first extension and the second extension are each resilient. The second passage tapers outwardly extending from the fourth end to the third end such that the diameter of the second passage is greater at the third end relative to the diameter of the second passage at the fourth end. The plug is comprised of a first half releasably attached to a second half and may be hinged thereto. The plug has a ridge located on an exterior surface of the plug such that the ridge slides within the channel for preventing the plug from torqueing within the sheath.

BRIEF DESCRIPTION OF THE DRAWINGS

Similar reference numerals refer to similar parts throughout the several views of the drawings.

DESCRIPTION OF THE PREFERRED EMBODIMENT

Figure 1:
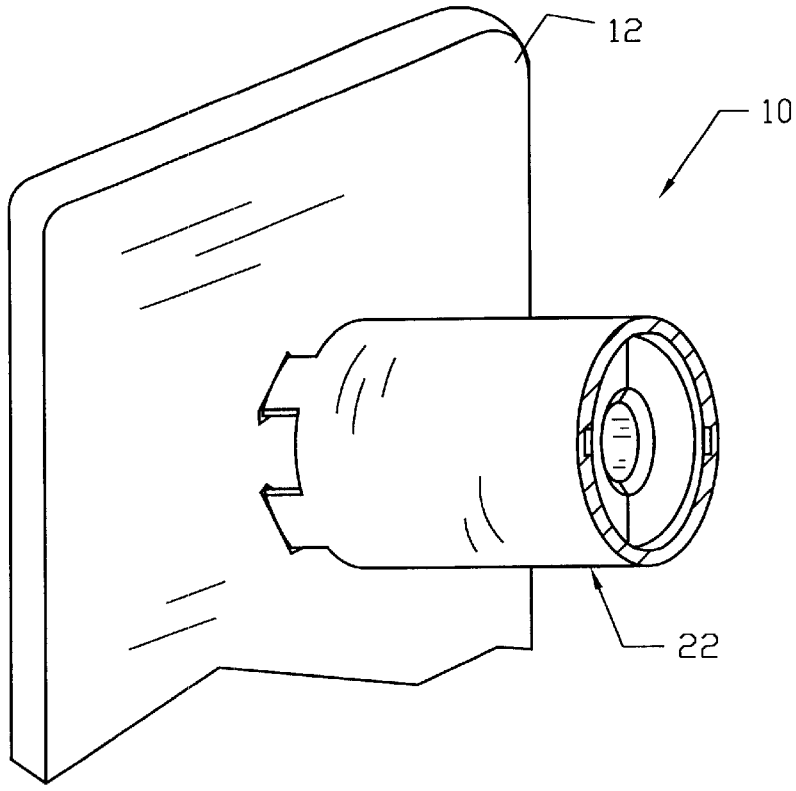
FIG. 1 is an environmental view of the plug lock of the present invention.
Figure 2:
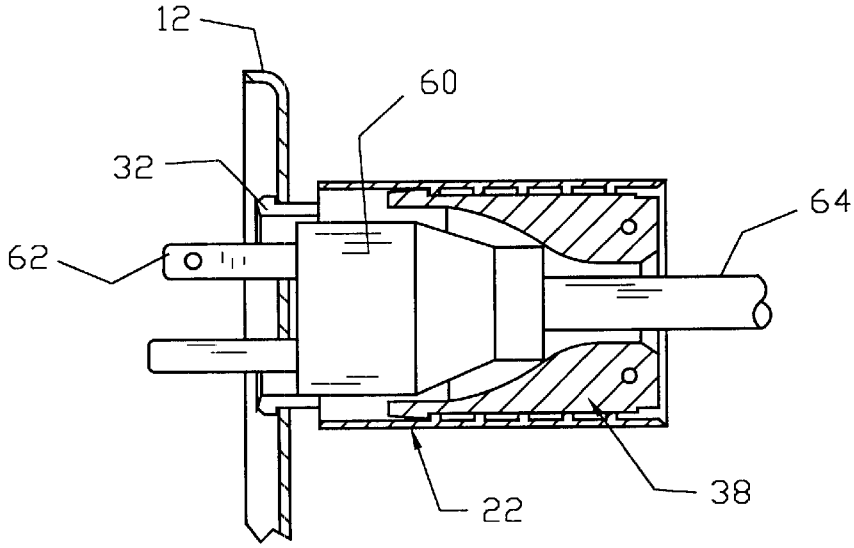
FIG. 2 is a side sectioned view of FIG. 1.
Figure 3:
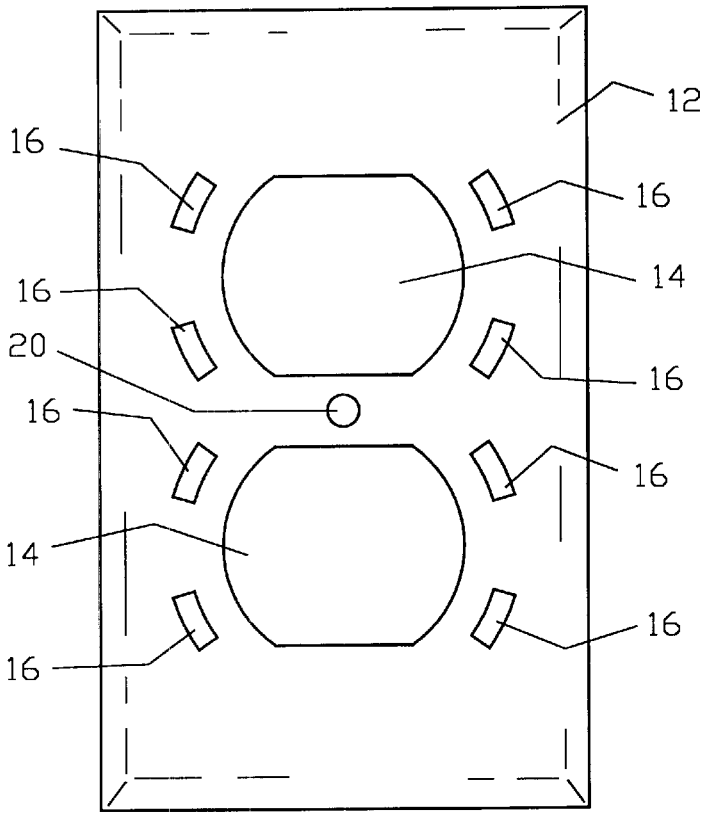
FIG. 3 is a front elevation view of the wall plate.
Figure 4:
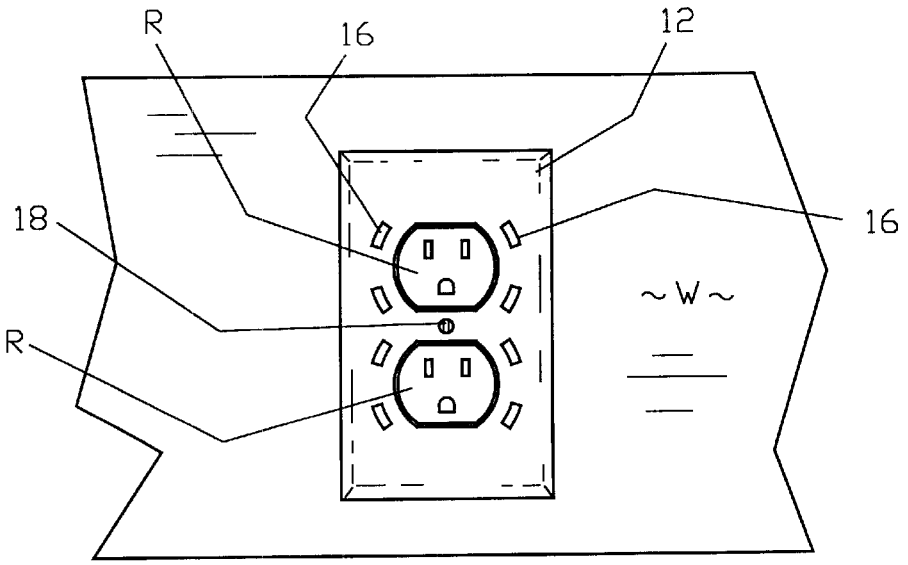
FIG. 4 is a front elevation view of the wall plate attached to the wall.
Figure 5:
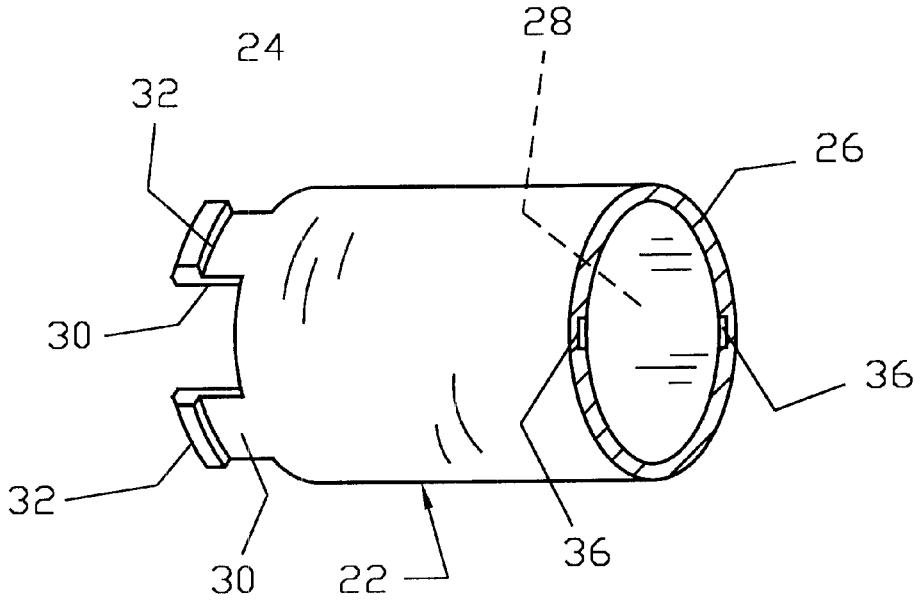
FIG. 5 is a perspective view of the sheath.
Figure 6:
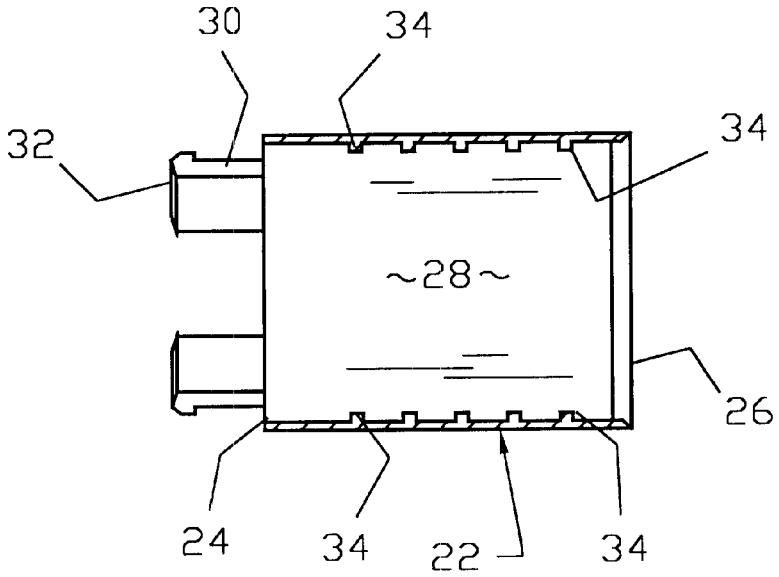
FIG. 6 is a side sectioned view of the sheath.
Figure 7:
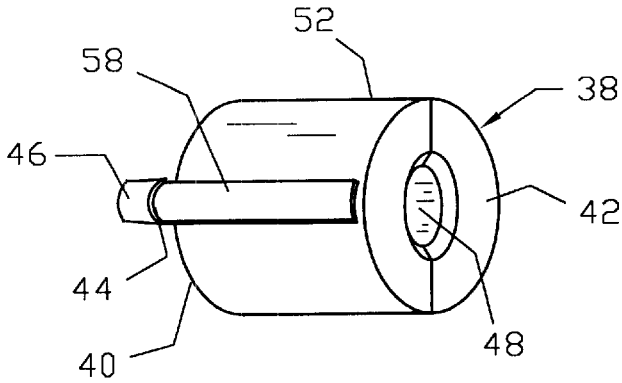
FIG. 7 is a perspective view of the plug.
Figure 8:
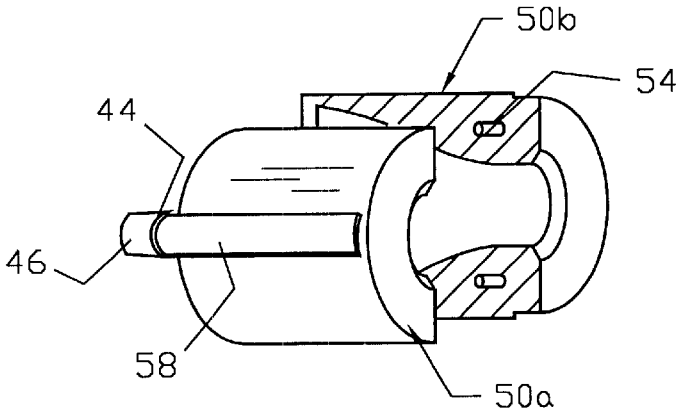
FIG. 8 is a perspective view of the plug disassembled.
Figure 9:
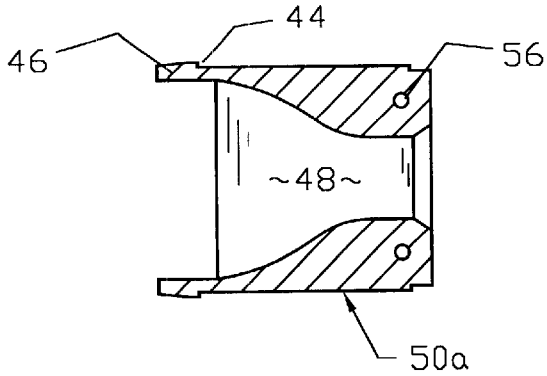
FIG. 9 is a side elevation view of one of the halves of the plug.

Referring now to the drawings, it is seen that the plug lock of the present invention, generally denoted by reference numeral 10, is comprised of a wall plate 12 having a first opening 14 and at least one second opening 16 located about the first opening 14. The wall plate 12 is a typical wall plate 12 that secures to a wall W of a building about one or more electrical receptacles R such each receptacle R protrudes through one of the first openings 14, the wall plate 12 having the addition of the second openings 16. The wall plate 12 is secured to the wall W in any standard fashion such as by passing a screw 18 through a third opening 20 located on the wall plate 12, the screw 18 receivable within the receptacle box (not illustrated) that holds the receptacles R.

A sheath 22 is provided and has a first end 24 and a second end 26 and has a first passage 28 extending between the first end 24 and the second end 26. A first extension 30 extends from the first end 24 of the sheath 22, the first extension 30 removably receivable within the second opening 16 of the wall plate 12. The first extension 30 is resilient and has a tab 32 that has a one-way ramp located thereon. At least one protrusion 34 is disposed within the first passage 28 of the sheath 22 along a channel 36. The second end 26 of the sheath 22 may be tapered to prevent chafing.

A plug 38 is provided, the plug 38 having a third end 40 and a fourth end 42 and having a second extension 44 extending from the third end 40. The second extension 44 is resilient and has a tab 46 that has a one-way ramp located thereon. A second passage 48 extends between the third end 40 and the fourth end 42. The second passage 48 tapers outwardly extending from the fourth end 42 to the third end 40 such that the diameter of the second passage 48 is greater at the third end 40 relative to the diameter of the second passage 48 at the fourth end 42. The plug 38 is comprised of a first half 50*a* attached to a second half 50*b*. The two halves 50*a* and 50*b* may, but need not be, hingedly attached to one another by providing an appropriate hinge 52 such as a living hinge. When the two halves 50*a* and 50*b* are brought together, they are held together by providing a peg 54 in one of the halves that is frictionally received within a peg hole 56 on the other half. This system provides a snug connection of the two halves 50*a* and 50*b* while allowing relatively easy separation of the halves. A ridge 58 is located on the outer surface of the plug 38. The fourth end 42 of the plug 38 may be tapered to prevent chafing.

The wall plate 12, the sheath 22, and the plug 38 are each made from an appropriate dielectric material such as plastic.

In order to use the plug lock 10 of the present invention, the wall plate 12 is secured to the wall W in appropriate fashion. The sheath 22 is attached to the wall plate 12 by inserting each first extension 30 into a corresponding second opening 16. If desired, the backside of each second opening 16 may be enclosed to prevent over insertion. The tab 32 of each first extension 30 prevents the extension 30 from being withdrawn from its second opening 16, as the non-ramped edge of the tab 32 abuts an inner surface of the second opening 16. An electrical plug 60 is positioned within the second passage 48 of the plug 38 such that prongs 62 and a portion of the electrical plug 60 itself extend outwardly from the third end 40 of the plug 38 and the cord 64 extends outwardly from the fourth end 42 of the plug 38. The two halves 50*a* and 50*b* are closed about the electrical plug 60 and the cord 64 is gently pulled on in order to secure the electrical plug 60 within the plug 38. The tapered nature of the second passage 48 of the plug 38 assures a snug fit of the electrical plug 60 within the plug 38.

The plug 38 is inserted into the first passage 28 of the sheath 22 through the second end 26 such that each second tab 46 is received within a respective channel 36 within the first passage 28 and the tab 46 passes over each of the protrusions 34 in that channel 36. The ramped nature of each second tab 46 prevents the plug 38 from being retracted from the sheath 22, as the non-ramped edge of the tab 46 abuts against the backside of the protrusion 34 and prevents reverse travel of the tab 46 and thus the plug 38. Accordingly, the plug 38 can travel in only one direction—from the second end 26 to the first end 24—within the sheath 22. If used, the ridge 58 on the plug 38 is received within a respective channel 36 within the first passage 28 of the sheath 22 in order to properly guide the plug 38 through the sheath 22 and to prevent the plug 38 from twisting or otherwise torqueing within the first passage 28.

The plug 38 is pushed through the sheath 22 until the electrical plug 60 is plugged into the electrical receptacle R located at the first end 24 of the sheath 22. As the plug 38 cannot be retracted through the sheath 22, and as the sheath 22 cannot be retracted from the wall plate 12, the electrical plug 60 is locked to the electrical receptacle R. In order to unlock the electrical plug 60 from the electrical receptacle R, the sheath 22 is detached from the wall plate 12 by pushing in on each of the first extensions 30 with a screwdriver or other appropriate instrument. As each second opening 16 is located some distance from any hot wire, the chance of electrical shock is minimal. Once the sheath 22 is detached from the wall plate 12, the electrical plug 60 can be withdrawn from the electrical receptacle R. Thereafter, the plug 38 is pushed all the way through the sheath 22 and the plug 38 is opened releasing the electrical plug 60. The electrical plug 60 is then pulled through the sheath 22 thereby releasing it from the plug lock 10.

If desired, the first extensions 30, each having a first tab 32 thereon, can be located directly on an end of the electrical plug 60 such that the plug itself can be locked directly into the second opening 16 of the wall plate 12.

While the invention has been particularly shown and described with reference to an embodiment thereof, it will be appreciated by those skilled in the art that various changes in form and detail may be made without departing from the spirit and scope of the invention.

I claim:

1. A plug lock comprising:

a wall plate having a first opening and a second opening located about the first opening;

a sheath having a first end and a second end and having a first passage extending between the first end and the second end, and having a first extension extending from the first end of the sheath, the first extension having a first tab and being removably receivable within the second opening;

at least one protrusion disposed within the first passage; and a plug having a third end and a fourth end and having a second extension having a second tab extending from the third end and a second passage extending between the third end and the fourth end, the third end of the plug insertable into first passage at the second end of the sheath and passable therethrough such that the second tab passes over each of the at least one protrusion such that the protrusion prevents reverse passage of the plug through the first passage.

2. The plug lock as in claim 1 wherein the first extension is resilient.

3. The plug lock as in claim 1 wherein the first tab is one-way ramped.

4. The plug lock as in claim 1 wherein the second extension is resilient.

5. The plug lock as in claim 1 wherein the second tab is one-way ramped.

6. The plug lock as in claim 1 wherein the second passage tapers outwardly extending from the fourth end to the third end.

7. The plug lock as in claim 1 wherein the diameter of the second passage is greater at the third end relative to the diameter of the second passage at the fourth end.

8. The plug lock as in claim 1 wherein the plug is comprised of a first half hingedly attached to a second half.

9. The plug lock as in claim 1 wherein the first passage has a channel disposed therein that receives a ridge located on an exterior surface of the plug such that the ridge slides within the channel.

10. A plug lock comprising:

a wall plate having a first opening adapted to receive an electrical receptacle therethrough and a second opening;

a sheath having a first extension removably receivable within the second opening and having a first passage; and a plug having a second passage and receivable within the first passage such that the plug can slide within the first passage in only one direction, the plug also having a second extension having a tab that passes, in series, over a plurality of protrusions disposed within the first passage of the sheath.

11. The plug lock as in claim 10 wherein the first extension has a tab.

12. The plug lock as in claim 11 wherein the tab has a one-way ramp thereon.

13. The plug lock as in claim 10 wherein the tab has a one-way ramp that is used to pass over the plurality of protrusions disposed within the first passage of the sheath.

14. The plug lock as in claim 10 wherein the second passage tapers outwardly extending from a first end to a second end.

15. The plug lock as in claim 10 wherein the diameter of the second passage is greater at a first end relative to the diameter of the second passage at a second end.

16. The plug lock as in claim 10 wherein the plug is comprised of a first half hingedly attached to a second half.

17. The plug lock as in claim 10 wherein the first passage has a channel disposed therein that receives a ridge located on an exterior surface of the plug such that the ridge slides within the channel.

18. A plug lock comprising:

a wall plate having a first opening adapted to receive an electrical receptacle therethrough and a second opening;

a sheath having a first extension removably receivable within the second opening and having a first passage; and a plug having a second passage, the second passage tapering outwardly extending from a first end to a second end, the plug receivable within the first passage such that the plug can slide within the first passage in only one direction.

19. The plug lock as in claim 18 wherein the first extension has a tab.

20. The plug lock as in claim 19 wherein the tab has a one-way ramp thereon.

21. The plug lock as in claim 18 wherein the diameter of the second passage is greater at a first end relative to the diameter of the second passage at a second end.

22. The plug lock as in claim 18 wherein the plug is comprised of a first half hingedly attached to a second half.

23. The plug lock as in claim 18 wherein the first passage has a channel disposed therein that receives a ridge located on an exterior surface of the plug such that the ridge slides within the channel.

24. A plug lock comprising:

a wall plate having a first opening adapted to receive an electrical receptacle therethrough and a second opening;

a sheath having a first extension removably receivable within the second opening and having a first passage; and a plug having a second passage, the diameter of the second passage is greater at a first end relative to the diameter of the second passage at a second end, the plug receivable within the first passage such that the plug can slide within the first passage in only one direction.

25. The plug lock as in claim 24 wherein the first extension has a tab.

26. The plug lock as in claim 25 wherein the tab has a one-way ramp thereon.

27. The plug lock as in claim 24 wherein the plug is comprised of a first half hingedly attached to a second half.

28. The plug lock as in claim 24 wherein the first passage has a channel disposed therein that receives a ridge located on an exterior surface of the plug such that the ridge slides within the channel.

29. A plug lock comprising:

a wall plate having a first opening adapted to receive an electrical receptacle therethrough and a second opening;

a sheath having a first extension removably receivable within the second opening and having a first passage; and a plug having a second passage and receivable within the first passage such that the plug can slide within the first passage in only one direction, the plug being comprised of a first half hingedly attached to a second half.

30. The plug lock as in claim 29 wherein the first extension has a tab.

31. The plug lock as in claim 30 wherein the tab has a one-way ramp thereon.

32. The plug lock as in claim 29 wherein the first passage has a channel disposed therein that receives a ridge located on an exterior surface of the plug such that the ridge slides within the channel.

33. A plug lock comprising:

a wall plate having a first opening adapted to receive an electrical receptacle therethrough and a second opening;

a sheath having a first extension removably receivable within the second opening and having a first passage;

a plug having a second passage and receivable within the first passage such that the plug can slide within the first passage in only one direction; and wherein the first passage has a channel disposed therein that receives a ridge located on an exterior surface of the plug such that the ridge slides within the channel.

34. The plug lock as in claim 33 wherein the first extension has a tab.

35. The plug lock as in claim 34 wherein the tab has a one-way ramp thereon.

* * * * *